US005297461A

United States Patent [19]

Hirakawa et al.

[11] Patent Number: 5,297,461

[45] Date of Patent: Mar. 29, 1994

[54] ROTARY SHEAR

[75] Inventors: Tadashi Hirakawa, Hiroshima; Hideo Nobuhara, Tokyo; Makoto Ando, Hiroshima, all of Japan

[73] Assignee: Mitsubishi Jukogyo Kabushiki Kaisha, Tokyo, Japan

[21] Appl. No.: 945,249

[22] Filed: Sep. 15, 1992

[30] Foreign Application Priority Data

Sep. 25, 1991 [JP] Japan ..... 3-271825

[51] Int. Cl.[5] ..... B26D 1/62; B26D 3/14

[52] U.S. Cl. ..... 83/304; 83/347; 83/659; 83/678; 83/693

[58] Field of Search ..... 83/305, 346, 347, 348, 83/508.2, 508.3, 659, 671, 678, 693, 304

[56] References Cited

U.S. PATENT DOCUMENTS 3,522,762 8/1970 Sauer ..... 83/659 X 4,989,487 2/1991 Staley ..... 83/659 X

FOREIGN PATENT DOCUMENTS 288142 10/1915 Fed. Rep. of Germany .

*Primary Examiner*—Eugenia Jones

*Assistant Examiner*—Raymond D. Woods

*Attorney, Agent, or Firm*—Rothwell, Figg, Ernst & Kurz

[57] ABSTRACT

An anvil cylinder is severed along an axial direction of a shaft into a plurality of ring-shaped sections, and elastic bodies are fixedly secured to parts of outer circumferential surfaces of the severed anvil cylinder sections over the entire length of the cylinder. In addition, the respective anvil cylinder sections are adapted to be individually engaged with or disengaged from a knife with the aid of a rotary object. By adjusting the positions of the anvil cylinder sections, slitting slots can be formed by machining only at the portions where slitting slots are necessitated.

3 Claims, 9 Drawing Sheets

ROTARY SHEAR

BACKGROUND OF THE INVENTION

1. Field of the Invention

The present invention relates to a rotary shear adapted to be actuated upon order change for cutting a running corrugated cardboard web or forming a slitting slot in the direction of its lateral width.

2. Description of the Prior Art

A description will be made of the construction and function (operation) of a rotary shear in the prior art with reference to FIGS. 6 to 10. A rotary shear is an apparatus acting upon a corrugated cardboard web 6 manufactured continuously in a corrugating machine. A process for cutting or applying a slitting slot working across its widthwise direction will be described. This apparatus operates at the time of order change, and has a function of dealing with resetting such as change of a set width of a trim 8, a set width of a sheet 7, and the like. In the following, a construction and a function of a rotary shear in the prior art will be explained with reference to FIG. 7.

As shown in FIG. 7, a knife cylinder 2 having a knife 1 fixedly secured thereto has its opposite sides pivotably supported via bearings 16*a* and 16*b* from frames 5*a* and 5*b* erected at the opposite widthwise ends of the apparatus, a gear 17 is fixedly secured to its axial end portion on one side, and further to its outermost axial end is connected a shaft 19 via an electromagnetic clutch brake 18. To the same shaft 19 is mounted a pulley 20, and the same shaft 19 and a line shaft 21 are connected by means of a pulley 22 fixedly secured to the line shaft 21 and a belt 23. On the other hand, an anvil cylinder 24 is pivotably supported at its opposite ends via bearings 25*a* and 26*b* from the frames 5*a* and 5*b* as juxtaposed with the above-described knife cylinder 2. A shaft at one side end of the anvil cylinder 24 is connected to a shaft 27 via an electromagnetic clutch brake 26. To the shaft 27 is fixedly secured a gear 28, which is meshed with the gear 17 fixedly secured to the above-described knife cylinder 2. Also, to a shaft at the other side end of the anvil cylinder 24 is fixedly secured a pulley 29, and the same pulley 29 is connected to a pulley 32 fixedly secured to a shaft 31 via a belt 30. Furthermore, the shaft 31 is connected to an indexing motor 34 via an electromagnetic clutch brake 33. It is to be noted that in FIG. 7, reference numeral 6 designates a corrugated cardboard web traveling through a gap clearance between the anvil cylinder 24 and the knife cylinder 2 as held in rolling contact with the anvil cylinder 24.

As shown in a developed form in FIG. 9, the surface of the above-mentioned anvil cylinder 24 has steps (protrusions and recesses) formed in a part of the circumferential surface by removing the central portion of the anvil (elastic body) 35 over a successively decreasing length from the portion extending over the entire width L up to the portion having a predetermined length $L_o$. Accordingly, by differently setting a relative phase of the anvil cylinder 24 to be engaged with the knife 1 on the knife cylinder 2, various cutting works as shown in FIG. 10 can be achieved. That is, if the anvil cylinder 24 is engaged with the knife 1 at the position A in FIG. 9, then perfect cutting over the entire width can be done, while if it is engaged with the knife 1 at the position B in FIG. 9, then slitting slots corresponding to the length $P_o$ in FIGS. 9 and 10 can be formed at the opposite end portions of the width of the corrugated cardboard web 6. At the time of formation of the above-mentioned slitting slots, the portion corresponding to the length P in FIGS. 9 and 10 is a recessed portion formed on the roll surface of the anvil cylinder 24, accordingly, in this portion a pinching force (cutting force) between the roll surface and the knife 1 is not generated, and hence cutting is not effected. As described above, in the rotary shear of the illustrated type, provision is made such that by appropriately and variably setting the position B where the roll surface is engaged with the knife 1, slots having an arbitrary length of zero to a maximum $(W-L_o)/2$ can be machined at the opposite widthwise end portions of the corrugated cardboard web 6 (where W indicates a width of the corrugated cardboard web). FIG. 8 is a perspective view showing an operating state of the rotary shear, which clarifies an engaging state of the circumferential surface of the anvil cylinder 24 and the knife 1 on the knife cylinder 2 to be engaged, and a machining state for the traveling corrugated cardboard web 6.

Now, description will be made on a function of the above-described rotary shear.

As initial setting of the rotary shear, at first the electromagnetic clutch brake 26 is released, and after the interlocking with the knife cylinder 2 has been released, the electromagnetic clutch brake 33 in the section of the indexing motor 34 is actuated to connect, and by driving the same motor 34, a relative phase with respect to the knife 1 corresponding to a desired cut and machined state of the corrugated cardboard web 6 is adjustably realized (indexed). Subsequently, the electromagnetic clutch brake 33 is released, also the above-described electromagnetic clutch brake 26 is connected, and thereby setting is made so as to maintain the relative phase between the respective cylinders 2 and 24 and to interlock them with each other. In succession, the electromagnetic clutch brake 18 is actuated, and by switching on and off the power transmitted from the line shaft 21 at a predetermined timing, a slitting work or a cutting work is applied to the traveling corrugated cardboard web 6.

FIG. 12 is a schematic view of a slitter-scorer section positioned in the next step of process, and FIG. 11 illustrates a worked state of a corrugated cardboard sheet so as to correspond vertically in position to FIG. 12. Slitter-scorers Pa and Pb are apparatuses for applying predetermined score lines K and slitting slots S to a traveling corrugated cardboard web 6 by means of equipped scoring rolls 36*a* and 36*b* and slitter knives 37*a* and 37*b* as shown in FIGS. 11 and 12, and it is adapted to simultaneously manufacture a plurality of sheets (multiple manufacture) by properly selecting a corrugated cardboard web width W in relation to a product sheet width $W_o$ (FIG. 11 shows the case of double manufacture.). Also, in order to realize shortening of the time for resetting caused by order change, often the slitter-scorers are installed two sets Pa and Pb as aligned in the direction of traveling of sheets. It is to be noted that the entire width W of the above-described cardboard web under manufacture is chosen somewhat broader than the width $W_o$ to be used as product sheets, hence the opposite widthwise end portions where displacement or squeeze-out of paste at the time of sticking raw paper webs is liable to occur, are cut in a strip form, and they are sucked into the respective trim ducts 38 as waste paper sheets to be dealt with. The rotary shear in the prior art was an apparatus to be operated mainly as a trim shear that is useful for cutting the leading ends of the necessitated new order side trims 8*a* at the time of switching between slitter-scorers Pa and Pb as a result of an order change, that is, at the time of changing disposal of the trims 8 formed in correspondence to the width W of the corrugated cardboard web under manufacture and the width $W_o$ of the product sheets.

Next, brief explanation will be made on change of setting of the rotary shear in the prior art, which is operated as a trim shear.

With regard to change of a trimming position, in response to a signal issued from an order change system control unit not shown, besides setting in position of a trim duct 38*b*, various settings corresponding to the new order are effected in the slitter-scorer Pb in a standby state, and at the same time in a trim cutting device (rotary shear), for the purpose of setting a cut-away amount at the opposite widthwise ends of the corrugated cardboard web corresponding to the new order, a relative angular position of the anvil cylinder 24 with respect to the position of the knife 1 is preset. Subsequently, the knife cylinder 2 and the anvil cylinder 24 are rotated as opposed to each other at a predetermined timing for the corrugated cardboard web 6 to travel and pass therebetween, and a trim cutting notch is applied to a desired position. Next, the same notch position is transferred to the slitter-scorer Pb under a standby state, at first the scoring roll 36*b* is engaged at a predetermined position, subsequently the slitter knife 37*b* is engaged, and successively working according to the new order is effected. On the other hand, in a slitter-scorer Pa which has been working according to the old order, at a predetermined timing when the leading end of the corrugated cardboard sheet according to the new order reaches, the engagements with the scoring roll 36*a* and the slitter knife 37*a* are successively released. The new trims 8*b* produced from the corrugated cardboard web 6 according to the new order are respectively sucked and conveyed into a pair of newly set trim ducts 38*b* in a slitter-scorer Pb for use according to the new order, and after they have been shredded by a cutter-blower 39 equipped in the midway, they would be dealt with.

The rotary shear in the prior art was constructed and operated in the above-described manner, and it had only two kinds of functions of forming slitting slots of arbitrary length at the opposite widthwise ends of a traveling corrugated cardboard web, or perfectly cutting the same web over its entire width. Accordingly, as shown in FIG. 11, in setting of double manufacture, the specification can be stably switched only under a limited condition such that only the width of trims 8*a* at the ends of the width is changed according to order change, that is, the slitting slots for isolating sheets are continuous, in the case where cut lengths of two sheets traveling in parallel are the same even if the same slitting slots for isolating sheets should become discontinuous as a result of change of the sheet widths, or in the case where only one kind of sheets are manufactured from one web not shown. However, upon change of the specification according to order change, in many cases not only the widthwise dimension of the sheet 7 changes but also cut lengths of the two sheets 7 traveling in parallel are also arbitrarily changed as shown in FIG. 6. In double manufacture, wherein two kinds of sheets are manufactured in parallel from a single corrugated cardboard web, in the case where the cut lengths of the sheets traveling in parallel are different from each other, a traveling route of the sheet on one side is changed at a cut-off in the downstream step of process not shown, and they are cut into predetermined lengths by transferring them respectively to separate rotary drum shears.

Accordingly, in the case where the specification has been changed, for instance, as illustrated in FIG. 6, a discontinuous portion marked * would remain in the central slitting slot, and so, at the time of change of the traveling route (separation to the above and the below) at the cut off in the downstream step of process carried out in the event that the lengths of the above-described sheets traveling in parallel are different from each other, not only the above-described discontinuous portion would break and become unacceptable paper sheets, but also troubles such that the broken pieces of sheet are engaged with conveying means at the downstream (feed rolls) resulting in jam-up, would occur frequently. From these reasons, in the rotary shear in the prior art, in the case where the position of the slitting slot for isolating the sheet is to be changed, the method of once cutting and separating the preceding and succeeding corrugated cardboard web portions over their entire width at the time of order change and thereby obviating damage of the sheets occurring at the above-described discontinuous portion (the portion marked * in FIG. 6), was employed. However, this method has a shortcoming that restraint of a trailing end of an old order sheet and a leading end of a new order sheet would temporarily become free, and hence zig-zag traveling of sheets 7 and variation of a conveying velocity would occur. Consequently, precision in the cut length and the like would become not guaranteed, and would become a principal cause of various troubles which may possibly occur during the period before a new sheet traveling condition becomes stable.

As described in the preceding paragraphs, the rotary shears in the prior art could achieve only two kinds of cutting works of machining slitting slots in the widthwise direction of a sheet at the opposite ends of a width of a corrugated cardboard web, and perfectly cutting a sheet over its entire width. Accordingly, although a sheet can be dealt with (switched) smoothly by slitting slots formed at the opposite ends of a width under a limited condition such that only a trim width is changed as a result of order change, in multiple manufacture wherein two kinds (a multiple of kinds) of sheets having different lengths are manufactured from a single corrugated cardboard web, for instance, in the case where a width of sheets is changed at the order change and cut sheet lengths are different, then a slitting position is displaced in the widthwise direction of a sheet at a change point between the old and new orders, resulting in a discontinuous portion, hence the sheet would break as a result of separation of a sheet traveling route at a cut-off in the next step of process, and the sheet would become an unacceptable paper sheet. Not only such troubles, but also it would become a principal cause of various troubles such that the broken sheet pieces may plug the space between conveyor rolls in the next step of process and may cause jam-up. While, in the case where the sheet has been cut perfectly in the widthwise direction at the portion of the order change as a counter-measure for the above-described problems, though the disadvantage of breaking at the slitting position is eliminated, another problem would arise such that the ends of the new and old sheets would become free, hence the conveying condition becomes unstable, therefore the sheets would travel in a zig-zag manner or the traveling speed (amount) would vary, and a precision in a cutting dimension at the cut-off in the next step of process would be deteriorated.

SUMMARY OF THE INVENTION

It is therefore one object of the present invention to provide an improved rotary shear which is free from the above-mentioned shortcomings in the prior art.

A more specific object of the present invention is to provide a rotary shear, which can obviate the shortcoming of breaking of a sheet at a change point of a specification and the like even though new and old sheets are not perfectly separated. As is the case with the rotary shear in the prior art, dimensions of trim widths at the opposite widthwise ends of a sheet are changed as a result of order change, or widths of sheets vary in multiple manufacture for manufacturing a plurality of kinds of sheets have different cut lengths.

According to one feature of the present invention, there is provided a rotary shear of the type that it is disposed in a traveling passage of a corrugated cardboard web manufactured continuously by a corrugating machine and constructed so as to perform cutting and slitting in the widthwise direction of the corrugated cardboard web by rotational pinching between a knife on a knife cylinder and an elastic body fixedly secured to an outer circumferential surface of an anvil cylinder equipped above and under the above-mentioned web as opposed to each other, in which the anvil cylinder is severed into a plurality of sections along an axial direction of a shaft, the elastic body is fixedly secured to a part of an outer circumferential surface of each anvil cylinder section, and the elastic bodies can be respectively engaged with the knife in an arbitrarily adjustable manner.

According to another feature of the present invention, there is provided the above-featured rotary shear, in which another elastic body having a broad width is fixedly secured to the above-mentioned anvil cylinder while maintaining predetermined phase relationship with respect to that elastic body, and perfect cutting over the entire width of a sheet can be done regardless of the set position of the first-mentioned elastic body only by adjusting (indexing) the phase relationship of the aforementioned another elastic body with respect to the knife cylinder. According to the present invention, in the case where dimensions of trim widths at the opposite widthwise ends of a sheet changed as a result of order change, or in the case where widths of sheets vary in multiple manufacture for manufacturing a plurality of kinds of sheets having different cut lengths, owing to the fact that slitting slots directed in the widthwise direction of a sheet can be formed by machining only at necessary portions, the shortcoming of breaking of a sheet at a change point of a specification can be obviated even though the new and old sheets are not perfectly separated as a result of order change as is the case with the rotary shear in the prior art. Accordingly, with the rotary shear according to the present invention, the sheets can be conveyed stably, a precision in a cut dimension can be maintained accurately, and also, troubles such as jam-up and the like can be eliminated. It is to be noted that as a matter of course, cutting over the entire width or cutting only at the opposite widthwise end portions as is the case with the rotary shear in the prior art, is also possible by presetting the position (phase) of the anvil engaging with the knife.

The above-mentioned and other objects, features and advantages of the present invention will become more apparent by reference to the following description of preferred embodiments of the invention taken in conjunction with the accompanying drawings.

DESCRIPTION OF THE PREFERRED EMBODIMENTS

Figure 1:
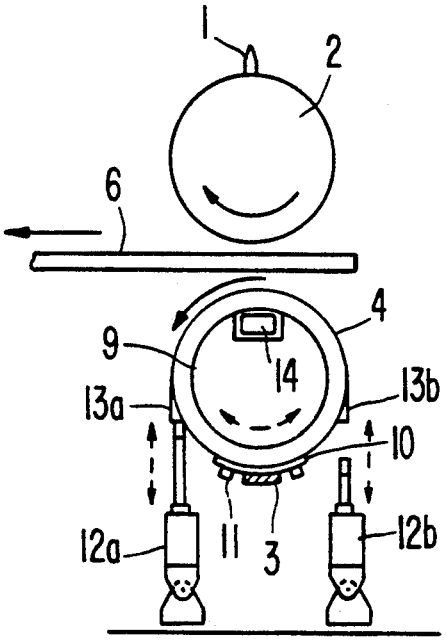
FIG. 1 is a cross-section side view showing a structure of an anvil cylinder section equipped in a rotary shear forming a first preferred embodiment of the present invention.

In the following, the present invention will be described in greater detail in connection to the preferred embodiments of the invention illustrated in the accompanying drawings. In the drawings, FIGS. 1 to 5 are schematic views showing a structure and a function of a rotary shear forming a first preferred embodiment of the present invention.

The rotary shear according to the first preferred embodiment is provided with a phase-adjusting (indexing) function for an anvil cylinder 4 adapted to be engaged with a knife 1. The function as a rotary shear of cutting a corrugated cardboard web 6 traveling between a knife cylinder 2 having the knife 1 fixedly secured thereto and an anvil cylinder 4 having an anvil (elastic body) 3 fixedly secured to its outer circumferential surface in its widthwise direction or machining slitting slots having a predetermined length by synchronously rotating the knife cylinder 2 and the anvil cylinder 4 as opposed to each other, is similar to that of the rotary shear in the prior art. This preferred embodiment achieves a better advantageous effect in the case of multiple manufacture in which two or more sheets 7 are manufactured in parallel from a single corrugated cardboard web 6, and has a characteristic advantage in that even in the event that a lateral width of the sheet 7 and/or a cut length of the sheet is changed as a result of order change, the sheets can be conveyed stably to the next step of process, as a whole, in a continuous state by slitting only a necessary portion in the lateral widthwise direction without perfectly cutting the sheet as is the case with the prior art.

In the following, description will be made on the structure. A structure of an anvil cylinder equipped in a rotary shear according to the first preferred embodiment of the present invention is illustrated in FIG. 1. In this figure, an anvil cylinder 4 is severed into a plurality of ring-shaped anvil cylinder sections along an axial direction of a shaft 9 which is rotatably supported, and the respective anvil cylinder sections are independently rotatable by a certain angle with respect to the shaft 9. In addition, to a part of the outer circumferential surface of the same ring-shaped anvil cylinder 4 is mounted via bolts 11 an anvil holding plate 10 having the anvil (elastic body) 3 fixedly secured thereto over its entire length. It is to be noted that in FIG. 1, reference numerals 12*a* and 12*b* designate a pair of air cylinders positioned under the anvil cylinder 4, which are adapted to push out hooks 13*a* and 13*b* projected from the outer circumferential surface of the anvil cylinder 4 by their expansion/contraction operations and to rotate the respective severed sections of the anvil cylinder 4 about the shaft 9, so that the phases of the respective severed sections of the anvil cylinder 4 with respect to the shaft 9 can be varied. Also, in FIG. 1, reference numeral 14 designates a tube fitted in a groove formed in the axial direction on the outer circumferential surface of the shaft 9, which is adapted to fix the ring-shaped anvil cylinder 4 at the preset position by sealingly filling air at a predetermined pressure in the tube. This fixing means is similar to the method of fixing heads in the heretofore known slitter-scorer.

Figure 2:
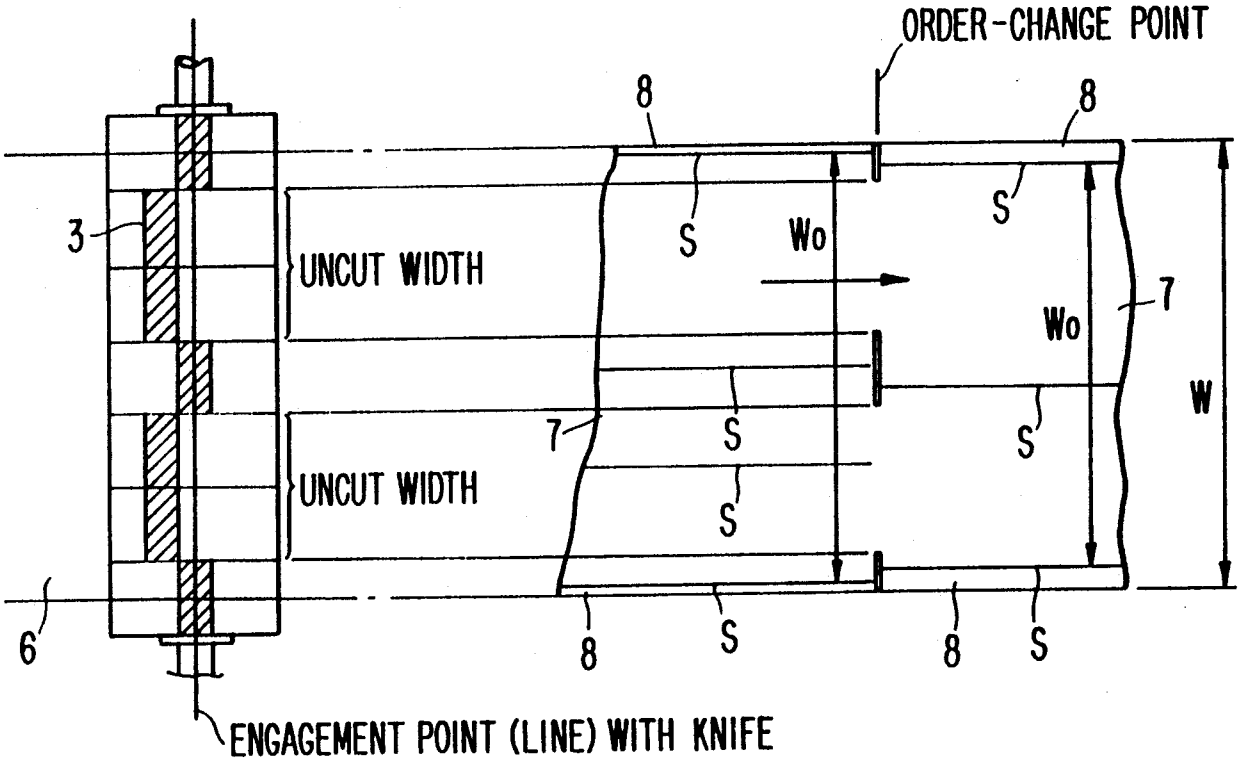
FIG. 2 is a schematic view showing one example of setting of the anvil cylinder shown in FIG. 1 and a worked state of a corrugated cardboard sheet by means of such anvil cylinder.
Figure 3:
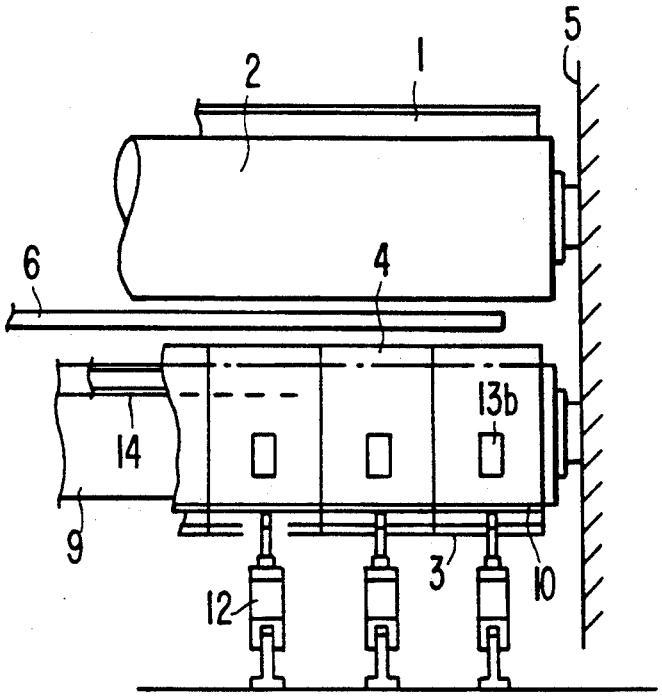
FIG. 3 is a front view of the rotary shear shown in FIG. 1.

With the above-mentioned construction, by selectively actuating the air cylinders 12*a* and 12*b*, the rotary shear is preset in such manner that the anvil (elastic body) 3 can be engaged with the knife 1 on the knife cylinder 2 only in a necessary portion, but in an unnecessary portion, the anvil 3 has its phase displaced from the engaging point with the same knife 1 so as not to come into contact with the knife. FIGS. 2 and 3 schematically show one example of setting of the anvil 3 and a pattern of slitting slots formed on a corrugated cardboard web 6 as a result of the same setting, in which only the portion of the anvil 3 engaged with the knife 1 is partly cut. Thereby, as a result of order change, damaging of sheets 7 is eliminated and stable conveyance of sheets can be achieved even in the event that not only a width of trims 8 and a width of product sheets are changed as shown in FIG. 2 but also traveling passages of sheets traveling in parallel are separated to the above and to the below due to difference of sheet cut lengths in the next step of process.

Figure 4:
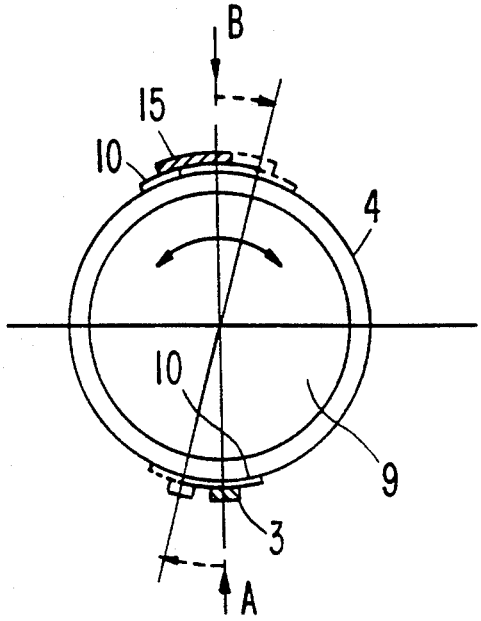
FIG. 4 is a schematic cross-section side view showing a structure of an anvil cylinder equipped in a rotary shear forming a second preferred embodiment of the present invention.
Figure 5:
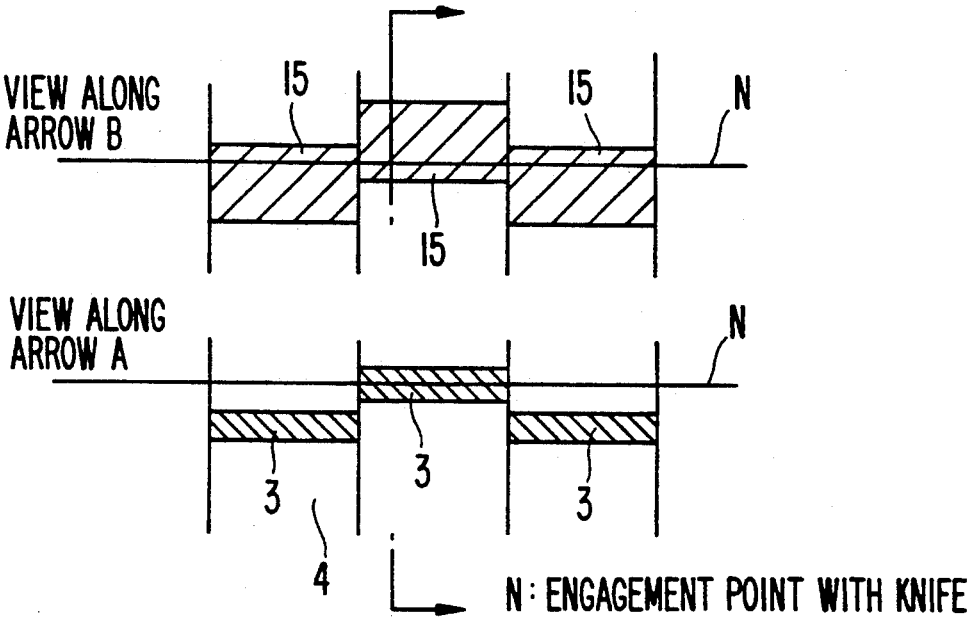
FIG. 5 is a schematic view showing one example of setting of the anvil cylinder according to the second preferred embodiment shown in FIG. 4.
Figure 6:
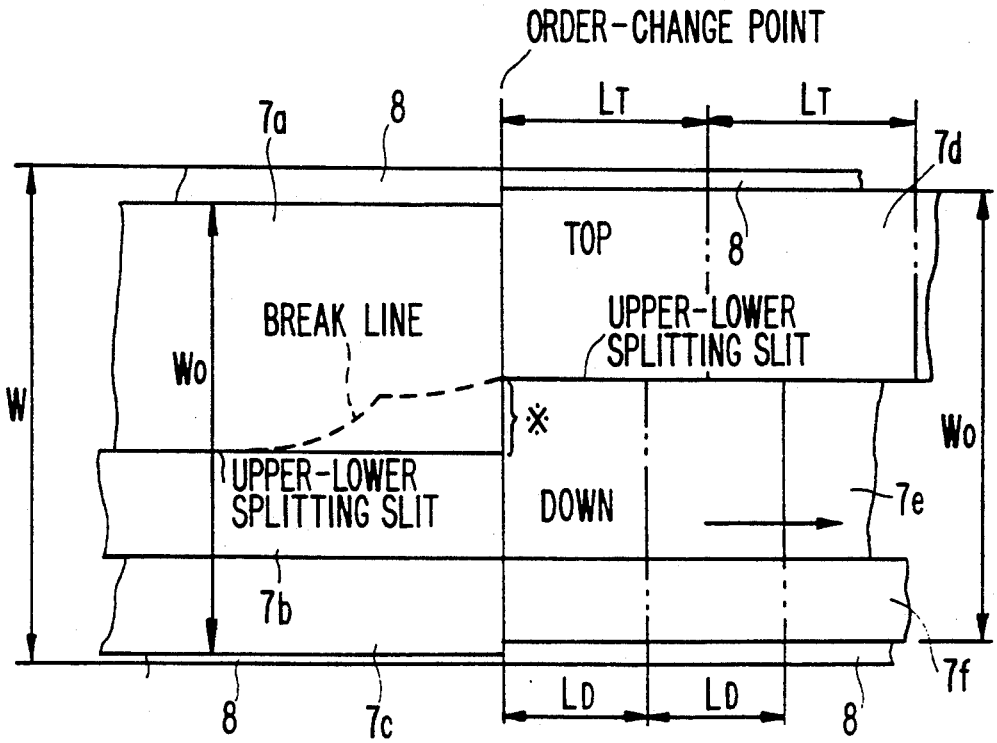
FIG. 6 (PRIOR ART)
FIG. 6 is a schematic view to be referred to for explaining disadvantages of the rotary shear in the prior art.
Figure 7:
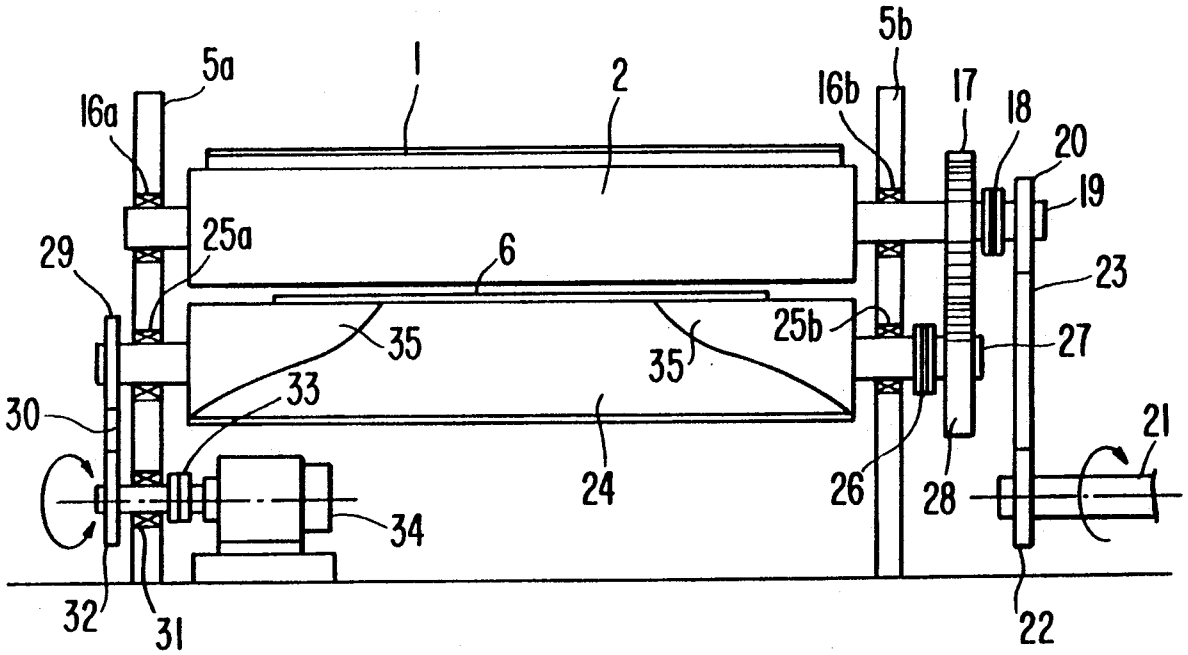
FIG. 7 (PRIOR ART)
FIG. 7 is a front view of the rotary shear in the prior art.
Figure 8:
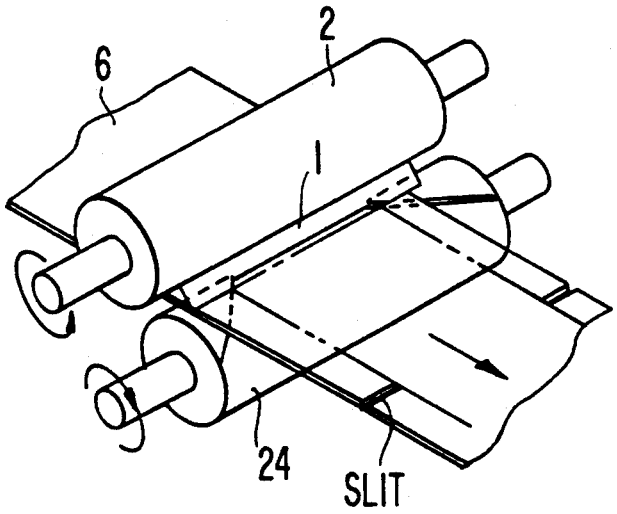
FIG. 8 (PRIOR ART)
FIG. 8 is a perspective view showing an operating state (working state) of the rotary shear in the prior art.
Figure 9:
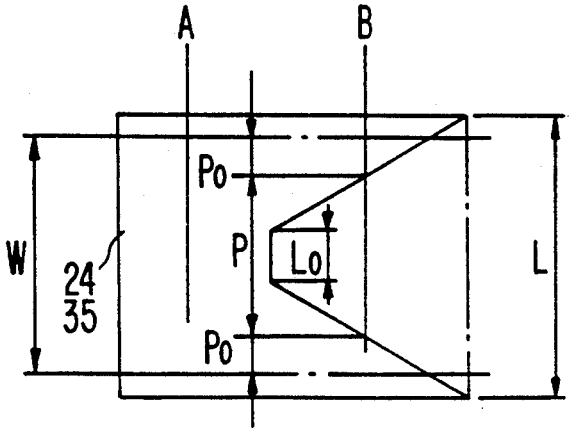
FIG. 9 (PRIOR ART)
FIG. 9 is a developed view of an outer circumferential surface of an anvil cylinder.
Figure 10:
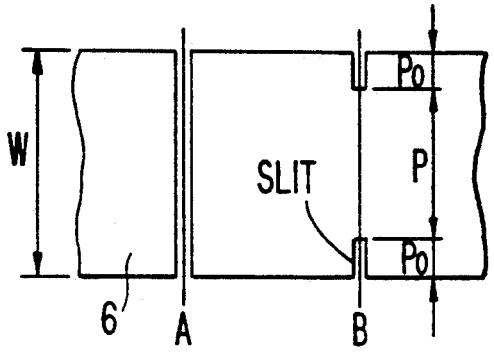
FIG. 10 (PRIOR ART)
FIG. 10 is a schematic view showing a worked state of a corrugated cardboard sheet, which corresponds in position to the developed view in FIG. 9.
Figure 11:
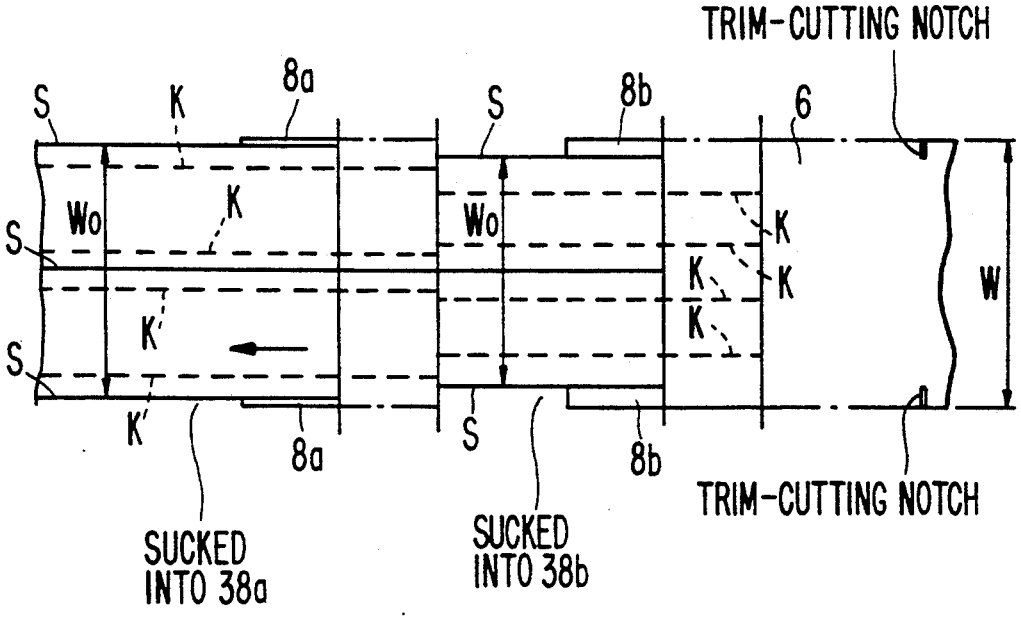
FIG. 11 (PRIOR ART)
FIG. 11 is a schematic view showing a state of scoring and cutting works in a corrugated cardboard sheet.
Figure 12:
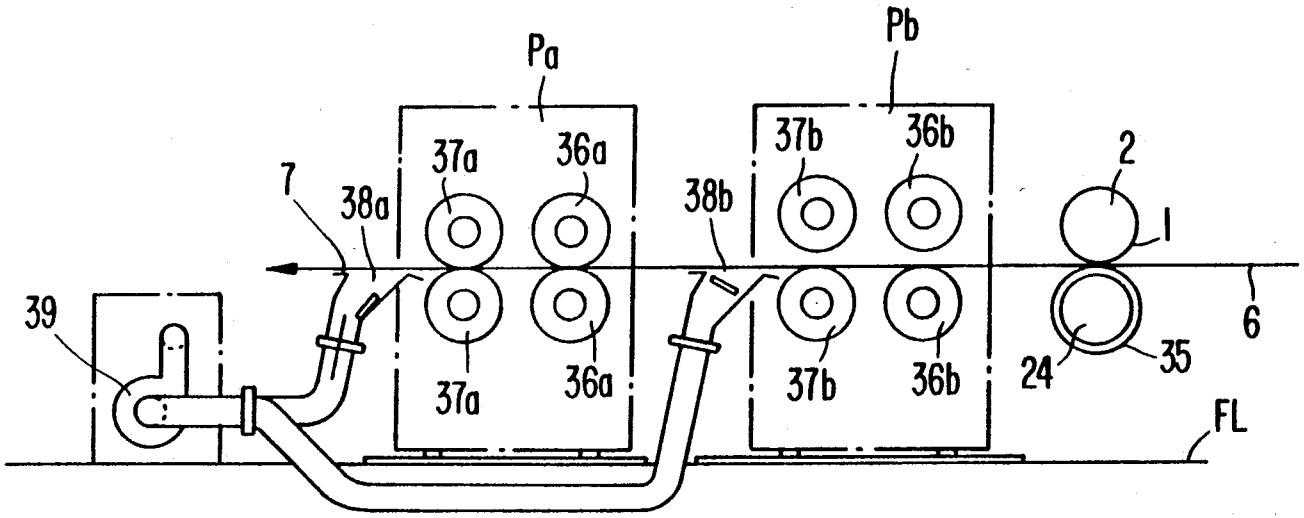
FIG. 12 (PRIOR ART)
FIG. 12 is a schematic view showing a slitter-scorer and a process of dealing with slitted trims.
Figure 13:
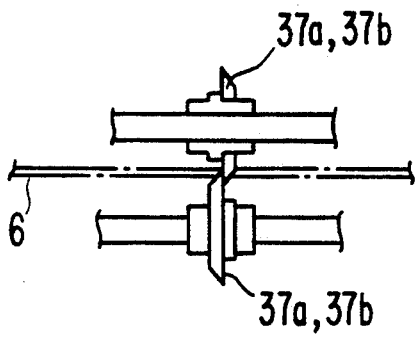
FIG. 13 is a schematic view showing a state of slitting by means of a slitter knife.
Figure 14:
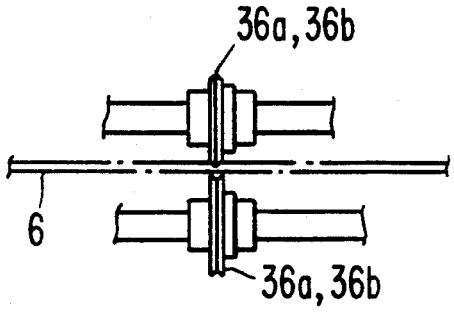
FIG. 14 is a schematic view showing a state of scoring by means of a scoring roll.

Next, FIGS. 4 and 5 illustrate a second preferred embodiment of the present invention, in which in addition to the above-described anvil 3, another anvil 15 having a broader width is equipped. Here, it is to be noted that perfect cutting in the direction of the sheet width in the above-described first preferred embodiment is possible also by disposing all the anvils 3 shown in FIGS. 1 and 2 at the nearly same angular position (phase) as aligned in the axial direction to be engaged with the knife 1. However, as is the case with the second preferred embodiment shown in FIGS. 4 and 5, if another anvil 15 having a longer arc length (a broader width) is fixedly secured to the ring-shaped anvil cylinders 4 at a different angular position thereon so that a part of the circumferential surfaces of all the anvils 15 may be always aligned in the axial direction even if the phases of the above-described anvils 3 for partial cutting are displaced, then at whatever position the above-mentioned anvils 3 for partial cutting may be set, by merely indexing the position of the shaft 9 on which the anvil cylinder 4 is fixed, the knife 1 can be engaged with the anvils 15. Owing to the above-mentioned construction, the rotary shear can quickly respond to an accidentally occurring demand for cutting and removal of an unacceptable paper sheet.

As described above, according to the present invention, since slitting slots can be formed only at necessary locations by presetting the anvils 3 for partial cutting, there is no need to perfectly cut a corrugated cardboard web over its entire width as is the case with the rotary shears in the prior art, and the sheets before and after order change (new and old sheets) can be conveyed to the next step of process in a continuous state. Therefore, stable conveyance of sheets can be maintained, and various problems involved in the rotary shears in the prior art such that a precision in a sheet cut length in the next step of process is deteriorated and troubles in conveyance of sheets are caused by jam-up, can be resolved. It is to be noted that with regard to the means for rotating the ring-shaped anvil cylinders and other partial structures, besides the illustrated constructions various modifications can be conceived.

As will be apparent from the detailed description of the preferred embodiments above, according to the present invention, since slitting slots in the widthwise direction of sheets necessitated at the time of order change can be formed at arbitrary positions, even in the case of manufacturing two or more kinds of sheets from a single corrugated cardboard web, smooth order change becomes possible even though the web is not perfectly cut over the entire region in the widthwise direction as is the case with the rotary shear in the prior art. In addition, because of the fact that new and old sheets are not cut to be separated as a result of order change, jam-up in the next step of process which would possibly occur at the time of high-speed order change or order change of sheets having poor tenacity, is obviated, and also zig-zag traveling of a trailing end of an old sheet and a leading end of a new sheet caused by overall cutting at the time of order change is eliminated. Furthermore, defects is a cut length generated by instability of traveling of sheets at the time of order change are eliminated, and moreover, excellent effects and advantages such that in view of the structure upon damage of the anvils they can be partly replaced, and shortening of a repair time as well as reduction of an expense can be achieved, are realized.

While a principle of the present invention has been described above in connection to preferred embodiments of the invention, it is a matter of course that many apparently widely different embodiments of the present invention can be made without departing from the spirit of the present invention.

What is claimed is:

1. A rotary shear disposed in a traveling passage of a corrugated cardboard web manufactured continuously by a corrugating machine and constructed so as to perform cutting and slitting in the widthwise direction of the corrugated cardboard web by rotational pinching between a knife on a knife cylinder and a first elastic body fixedly secured to an outer circumferential surface of an anvil cylinder equipped above and under said web and opposed to each other; wherein said anvil cylinder is comprised of a plurality of sections along an axial direction of a shaft supporting said anvil cylinder, the elastic body is fixedly secured to a part of an outer circumferential surface of an anvil cylinder section, and connecting means for connecting said anvil cylinder section to said shaft such that said anvil cylinder section is adjustable relative to said shaft to selectively position said elastic body between a first position in cutting phase with said knife and a second position out of cutting phase with said knife.

2. A rotary shear as claimed in claim 1, wherein a second elastic body having a broad width is fixedly secured to another anvil cylinder section and maintains a predetermined phase relationship with respect to said first elastic body, and cutting over the entire width of a sheet is accomplished by adjusting the predetermined phase relationship of said second elastic body with respect to said first elastic body.

3. A rotary shear as claimed in claim 1, further including air cylinders engaged with hooks projected from respective ones of the sections of the anvil cylinder for rotating respective ones of said sections with respect to the shaft.

* * * * *